US006863057B2

(12) United States Patent
Kawano

(10) Patent No.: US 6,863,057 B2
(45) Date of Patent: Mar. 8, 2005

(54) FUEL VAPOR TREATMENT SYSTEM

(75) Inventor: Akihiro Kawano, Atsugi (JP)

(73) Assignee: Nissan Motor Co., Ltd., Kanagawa (JP)

( * ) Notice: Subject to any disclaimer, the term of this patent is extended or adjusted under 35 U.S.C. 154(b) by 491 days.

(21) Appl. No.: 10/163,307

(22) Filed: Jun. 7, 2002

(65) Prior Publication Data

US 2003/0019481 A1 Jan. 30, 2003

(30) Foreign Application Priority Data

Jul. 30, 2001 (JP) ..... 2001-228962

(51) Int. Cl.[7] ..... F02M 25/08

(52) U.S. Cl. ..... 123/518; 123/519; 123/520; 123/494; 123/677

(58) Field of Search ..... 123/516, 518, 123/519, 520, 406.49, 465, 494, 677

(56) References Cited

U.S. PATENT DOCUMENTS 5,592,923 A * 1/1997 Machida ..... 123/520
5,732,687 A 3/1998 Hashimoto et al.
5,767,395 A 6/1998 Goto et al.
5,845,625 A 12/1998 Kidokoro et al.
5,911,209 A * 6/1999 Kouda et al. ..... 123/520
6,105,556 A * 8/2000 Takaku et al. ..... 123/520
6,220,229 B1 * 4/2001 Kawamura et al. ..... 123/520
6,227,037 B1 5/2001 Kawamura et al.
6,276,343 B1 * 8/2001 Kawamura et al. ..... 123/520

FOREIGN PATENT DOCUMENTS

JP 7-317611 A 12/1995
JP 9-126064 A 5/1997
JP 2001-107776 A 4/2001

* cited by examiner

*Primary Examiner*—Weilun Lo
(74) *Attorney, Agent, or Firm*—Shinjyu Global IP Counselors, LLP

(57) ABSTRACT

A fuel vapor treatment system is provided that diagnoses failure of the purge valve using one absolute pressure sensor. The fuel vapor treatment system includes a fuel tank, a canister, a drain cut valve, a purge valve, purge piping and a sensor. The canister adsorbs fuel vapor evaporated from the fuel tank. The drain cut valve controls the introduction of air into the canister. The purge valve is disposed between the canister and an intake passage into which fuel vapor flows from the canister. The purge piping communicates between the fuel tank and the intake passage via the canister. The sensor detects the absolute pressure inside the purge piping. The fuel vapor treatment system is further equipped with an atmospheric pressure setting device that sets the value detected by the sensor when the drain cut valve is open as the atmospheric pressure used for controlling the engine.

12 Claims, 4 Drawing Sheets

FUEL VAPOR TREATMENT SYSTEM

BACKGROUND OF THE INVENTION

1. Field of the Invention

The present invention generally relates to a fuel vapor treatment system. More specifically, the present invention relates an improvement to a fuel vapor treatment system equipped with an absolute pressure sensor.

2. Background Information

An example of a fuel vapor treatment system is described in Japanese Laid-Open Patent Publication No. 07-317611. This fuel vapor treatment system has an absolute pressure sensor installed in the evaporation passage that communicates between the fuel tank and the canister. By measuring the atmospheric pressure as a reference pressure, this fuel vapor treatment system diagnoses leaks inside the fuel vapor treatment system based on the difference between the reference pressure and the pressure inside the evaporation passage.

In view of the above, there exists a need for an improved fuel vapor treatment system. This invention addresses this need in the art as well as other needs, which will bercome apparent to those skilled in the art from this disclosure.

SUMMARY OF THE INVENTION

It has been discovered that the aforementioned fuel vapor leak diagnosis device requires the installation of two sensors, i.e., an absolute pressure sensor and an atmospheric pressure sensor. Thus, the installation of the two sensors results in a more costly vapor leak diagnosis device.

If the atmospheric pressure sensor is eliminated, then the pressure inside the fuel vapor treatment system will fluctuate during the failure diagnosis because the drain cut valve is closed and when the engine is started negative pressure will develop inside the intake manifold. This creates a problem in a control unit that compensates using the atmospheric pressure. For example, an engine control unit 6 is disclosed in Japanese Laid-Open Patent Publication No. 2001-107776, in which atmospheric pressure is used to regulate the fuel injection quantity. Thus, engine control in this system cannot be properly conducted when the pressure inside the fuel vapor treatment system fluctuates.

Therefore, an object of the present invention is to provide a fuel vapor treatment system that solves the aforementioned problems.

In accordance with the present invention, a fuel vapor treatment system is provided that basically comprises a fuel tank, a canister, a purge valve, a sensor and an atmospheric pressure setting device. The canister is fluidly coupled to the fuel tank by a first pipe and configured to adsorb fuel vapor evaporated from the fuel tank. The drain cut valve is operatively coupled to the canister to control air flow into the canister. The purge valve is disposed in a second pipe fluidly coupled between the canister and an intake passage of an internal combustion engine into which fuel vapor flows from the canister. The sensor is configured and arranged to detect absolute pressure inside at least one of the first and second pipes. The atmospheric pressure setting device is configured and arranged to set a value detected by the sensor when the drain cut valve is open as atmospheric pressure to control the internal combustion engine.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
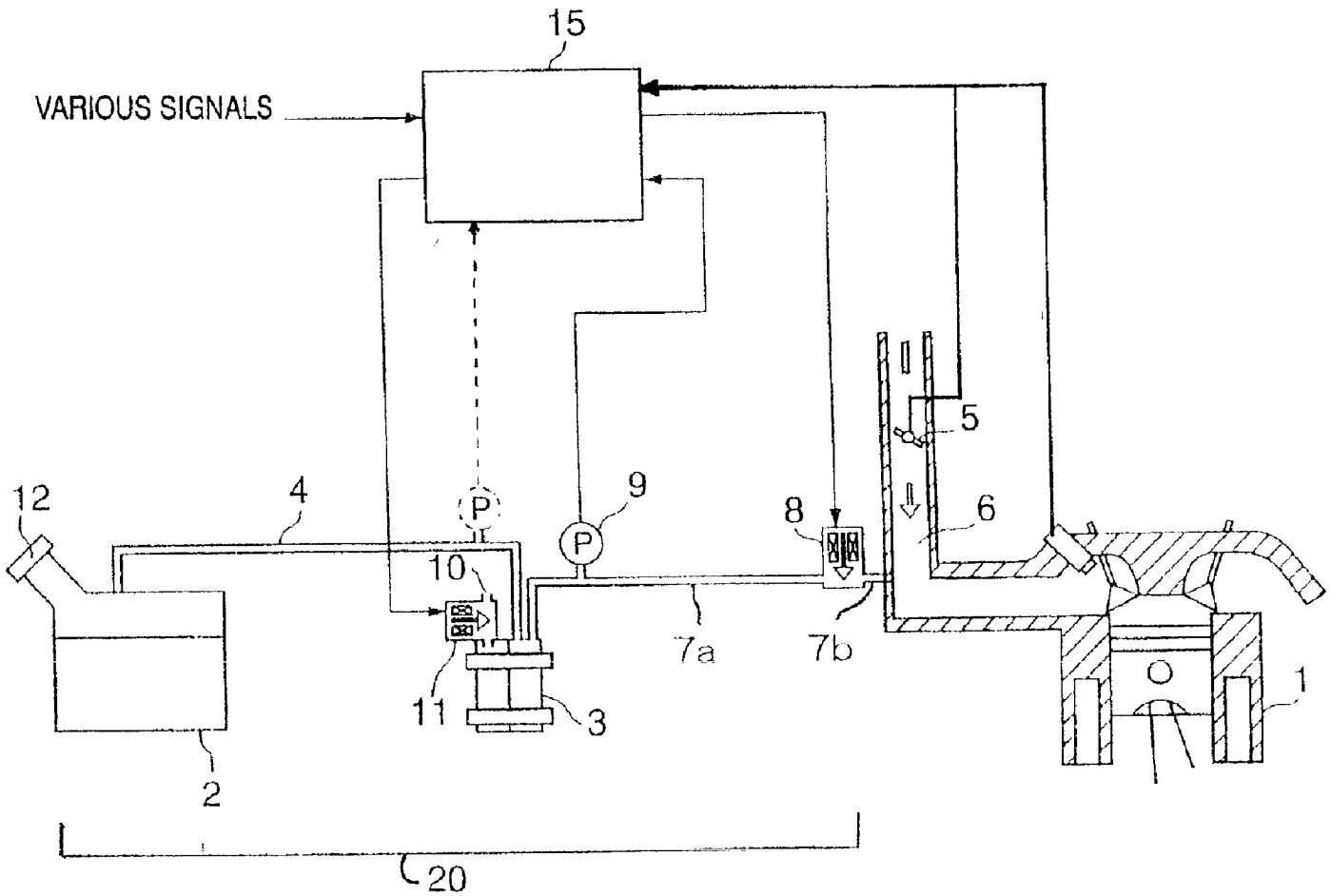
FIG. 1 is a schematic view of a fuel vapor treatment system in accordance with one embodiment of the present invention.

Referring initially to FIG. 1, a schematic view of a fuel vapor treatment system 20 is illustrated in accordance with a first embodiment of the present invention. The fuel vapor treatment system 20 serves to treat fuel vapor that is generated inside a fuel tank 2 of an engine 1 that is equipped with a canister 3 containing a fuel adsorbing material (e.g., activated carbon). The fuel tank 2 and the canister 3 are fluidly coupled together by a purge pipe 4. The canister 3 is also fluidly coupled to an intake passage 6 by a pair of purge pipes 7*a* and 7*b* at location that is downstream of a throttle valve 5 of the engine 1. The purge pipes 4, 7*a* and 7*b* together form a purge piping that interconnects the fuel tank 2 to the intake passage 6 via the canister 3. The purge pipe 4 forms a first purge pipe extending between the fuel tank 2 and the canister 3, while the purge pipes 7*a* and 7*b* form a second purge pipe extending between the canister 3 and the intake passage 6.

A purge valve 8 is provided between the purge pipes 7*a* and 7*b* for opening and closing the connection between the purge pipes 7*a* and 7*b*. An absolute pressure sensor 9 measures both the pressure (absolute pressure) inside the purge piping and the atmospheric pressure (absolute pressure), in a manner described later. The absolute pressure sensor 9 is located between the fuel tank 2 and the purge valve 8. Thus, it is also acceptable to install the absolute pressure sensor 9 anywhere in the first purge pipe 4 such as shown in broken lines in FIG. 1.

The canister 3 is provided with an atmospheric release port 10. Preferably, the atmospheric release port 10 is part of a drain cut valve 11, which closes the atmospheric release port 10.

Fuel vapor generated inside the fuel tank 2 is directed to the canister 3 through the first purge pipe 4. The fuel component of the vapor is adsorbed by the activated carbon inside the canister 3, while the remaining air is discharged to the outside through the atmospheric release port 10. Then, in order to treat the fuel adsorbed by the activated carbon, the purge valve 8 opens and fresh air is introduced into the canister 3 through the atmospheric release port 10 by utilizing the negative intake pressure downstream of the throttle valve 5. This fresh air causes the adsorbed fuel to separate from the activated carbon and be removed together with the fresh air into the intake passage 6 of the engine 1 through the purge pipes 7*a* and 7*b*.

The pressure value detected by the absolute pressure sensor 9 is sent to a controller 15 that functions as an atmospheric pressure setting device. The controller 15 preferably includes a microcomputer with a control program that controls the operation of the engine 1 and the fuel vapor treatment system 20 as discussed below. The controller 15 can also include other conventional components such as an input interface circuit, an output interface circuit, and storage devices such as a ROM (Read Only Memory) device and a RAM (Random Access Memory) device. The memory circuit stores processing results and control programs that are run by the processor circuit. The controller 15 is operatively coupled to the various sensors in a conventional manner. The internal RAM of the controller 15 stores statuses of operational flags and various control data. The internal ROM of the controller 15 stores the signals from the various sensors and the operational states of the purge valve 8 and the drain cut valve 11 for various operations. The controller 15 is capable of selectively controlling any of the components of the control system in accordance with the control program. It will be apparent to those skilled in the art from this disclosure that the precise structure and algorithms for the controller 15 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The controller 15 receives at least the following signals: an output signal indicating the boost pressure inside the intake passage 6, an ON-OFF signal from an ignition switch, an ON-OFF signal from a starter switch that starts a starter motor, a battery voltage signal, and an engine speed signal. The controller 15 preferably also receives informational signals from a fuel temperature sensor, and various other sensors that detect the operating conditions of the engine. Based on at least these input values, the engine speed, intake air flow rate, throttle opening, coolant temperature, intake air temperature, vehicle speed, fuel temperature, fuel injection quantity, etc., the controller 15 opens and closes the purge valve 8 and the drain cut valve 11 in response to the operating conditions of the engine 1 and controls the purging of the adsorbed fuel vapor from the canister 3. In other words, the controller 15 opens and closes the purge valve 8 in specified operating regions (e.g., steady-state travel) and executes purge control (steady-state purge treatment) by controlling the opening and closing of the purge valve 8. Also based on at least some of these input valves, the controller 15 is configured to control the throttle valve 5 and the fuel injector as seen in FIG. 1 as well as other engine components such as the intake valves, the exhaust valves, and the fuel igniter.

The controller 15 sets the pressure value detected by the sensor 9 as the true atmospheric pressure PAA when the drain cut valve 11 is open, and uses the resulting atmospheric pressure signal to control, for example, the fuel injection quantity or throttle opening of the internal combustion engine 1.

The pressure inside the first or second pipe 4 and 7*a* as detected by the sensor 9 is substantially equal to the atmospheric pressure when the drain cut valve 11 is open. By setting the pressure detected when the drain cut valve 11 is open as the atmospheric pressure, the atmospheric pressure can be detected without using an atmospheric pressure sensor and a separate atmospheric pressure sensor can be omitted.

When the drain cut valve 11 opens, the engine 1 is controlled as though the substitute atmospheric pressure PA used for controlling the internal combustion engine 1 is the same atmospheric pressure as when the drain cut valve 11 was closed. Consequently, the influence of the negative pressure caused by running the engine 1 can be eliminated and atmospheric pressure control can be executed continuously. In other words, control of an internal combustion engine 1 that involves compensation using the atmospheric pressure can be executed continuously.

When the drain cut valve 11 switches from the closed state to the open state, the substitute atmospheric pressure PA is revised gradually until the difference between the substitute atmospheric pressure PA and the true atmospheric pressure PAA detected by the sensor 9 is less than or equal to a prescribed pressure PIA. The revised substitute atmospheric pressure PA is set as a new substitute atmospheric pressure and the new substitute atmospheric pressure is used to control the internal combustion engine 1. Consequently, pressure fluctuations occurring when the drain cut valve 11 is switched can be suppressed effectively so that there is no effect on the operation and exhaust performance of the engine.

When the difference between the true atmospheric pressure PAA detected by the sensor 9 and the substitute atmospheric pressure PA becomes less than or equal to a prescribed value PIA, the substitute atmospheric pressure is revised such that the pressure difference is zero and the internal combustion engine 1 is controlled using this revised substitute atmospheric pressure. Consequently, when the pressure difference is less than or equal to a prescribed pressure PIA, the substitute atmospheric pressure PA can be controlled so as to immediately become the true atmospheric pressure PAA detected by the sensor 9.

Figure 2:
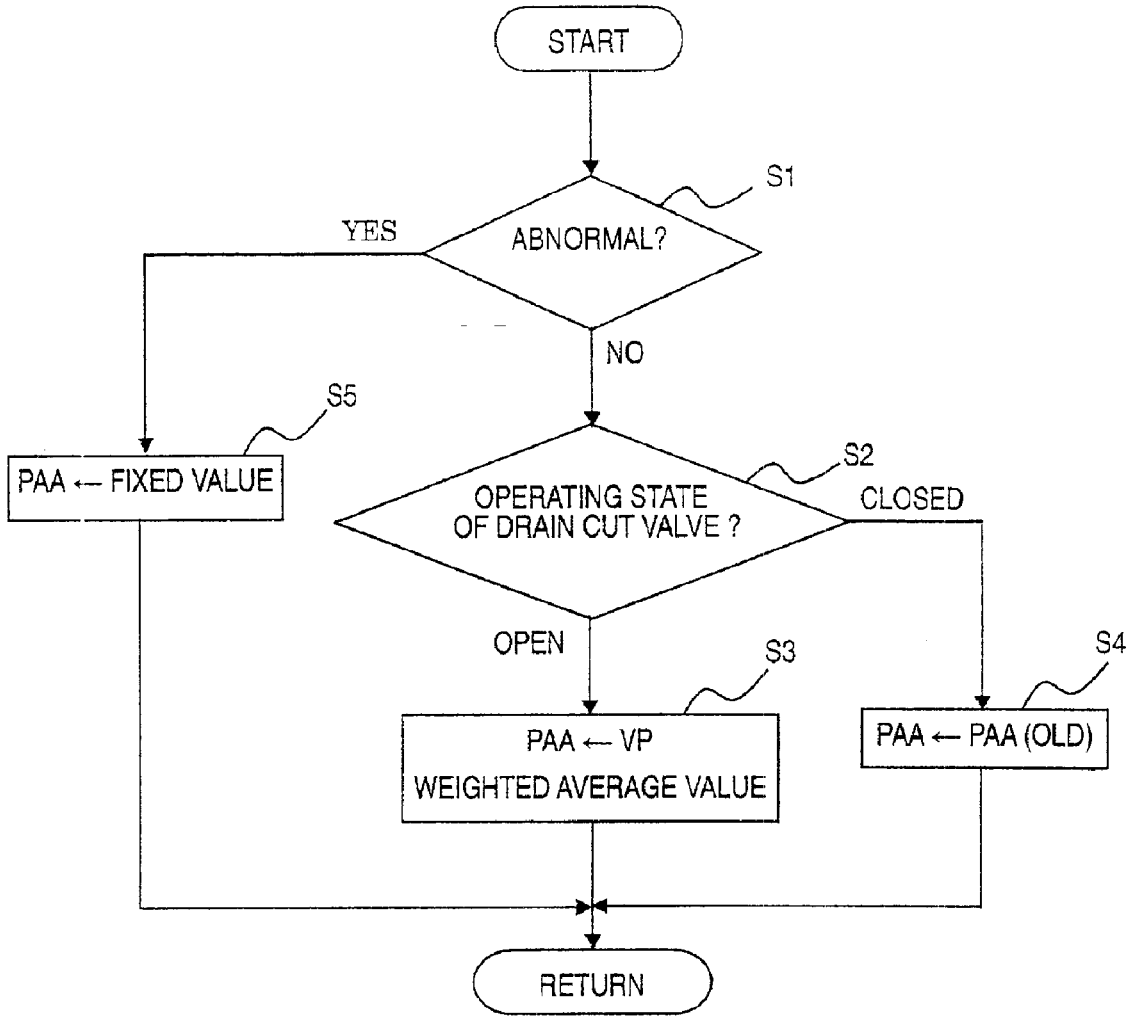
FIG. 2 is a control flowchart for determining a failure of a purge valve in the fuel vapor treatment system illustrated FIG. 1 in accordance with the present invention.
Figure 3:
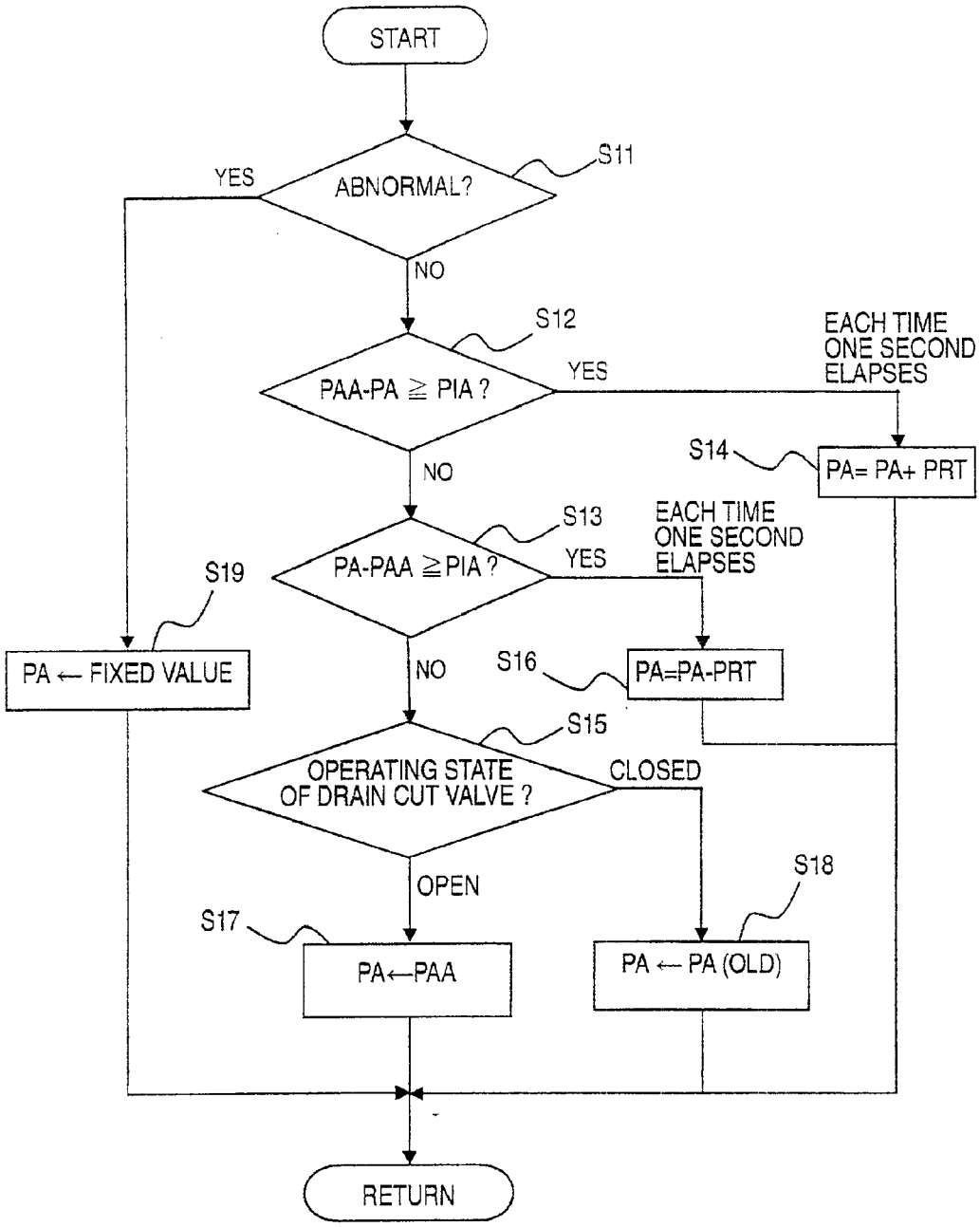
FIG. 3 is a control flowchart for determining a failure of a purge valve in the fuel vapor treatment system illustrated FIG. 1 in accordance with the present invention.

The atmospheric pressure control executed by the controller 15 is described using the flowcharts shown in FIGS. 2 and 3. The flowchart shown in FIG. 2 is used to compute the actual (true) absolute pressure (atmospheric pressure) PAA inside the passages of the first and second purge pipes 4 and 7*a*. The flowchart shown in FIG. 3 is used for setting the substitute atmospheric pressure when the drain cut valve 11 switches between the open and closed states under conditions where the atmospheric pressure changes.

First in Step S1, the controller 15 determines if the fuel vapor treatment system is operating in a normal manner or not. This determination is preferably accomplished by, for example, comparing the output value of the absolute pressure sensor 9 when the drain cut valve 11 is open with an output value previously obtained by the absolute pressure sensor 9 under atmospheric pressure. If the fuel vapor treatment system is operating in a normal manner, then the controller 15 proceeds to Step S2 where the controller 15 determines the operating state of the drain cut valve 11. If the drain cut valve 11 is open, then the controller 15 proceeds to Step S3 where the controller 15 adopts the weighted average of values VP detected by the absolute pressure sensor 9 as the true absolute pressure PAA. When the drain cut valve 11 is open, the pressure inside the second purge pipe 7*a* is almost the same as atmospheric pressure. Therefore, the true absolute pressure PAA is almost the same value as atmospheric pressure. If drain cut valve 11 is closed, the controller 15 proceeds to Step S4 where the value of the true absolute pressure PAA is maintained and not changed because the operation of the purge valve 8 might cause the negative pressure inside the intake passage 6 to affect the pressure inside the purge pipes 4, 7*a* and 7*b*, resulting in a pressure difference between the actual atmospheric pressure and the pressure inside the purge pipes 4, 7*a* and 7*b*.

If an abnormality in the fuel vapor treatment system is discovered in Step S1, then the controller 15 proceeds to Step S5 where the controller 15 sets a fixed value as the true absolute pressure PAA. Thus when the drain cut valve 11 is open, the true absolute pressure PAA is calculated based on the actual atmospheric pressure inside the purge pipes 4, 7*a* and 7*b* and the internal combustion engine 1 is controlled based on the value of this true absolute pressure.

Now, the flowchart of FIG. 3 is used to explain how the atmospheric pressure setting is conducted when the drain cut valve 11 switches from the open state to the closed state and when the drain cut valve 11 switches from the closed state to the open state under conditions where the atmospheric pressure changes.

With the present invention, when the drain cut valve 11 switches from the open state to the closed state, the atmospheric pressure setting is conducted such that the atmospheric pressure from when the drain cut valve 11 was open is held and used to control the internal combustion engine 1 while the drain cut valve 11 is closed. Now, it is feasible that the actual atmospheric pressure will change due to the travel of the vehicle while the drain cut valve 11 is closed. In such a case, when the drain cut valve 11 switches from closed to open, a pressure difference will exist between the pressure detected by the sensor 9 and the actual atmospheric pressure and such trouble as unstable operation of the internal combustion engine 1 could possible result. Therefore, the present invention sets a substitute atmospheric pressure so as to gradually change this pressure difference and executes various controls over the internal combustion engine 1 based on this substitute atmospheric pressure.

The flowchart shown in FIG. 3 is for setting the substitute atmospheric pressure. The substitute atmospheric pressure PA is set based on the true absolute pressure PAA inside the passages of the first or second purge pipes 4 and 7*a* and can be used in various controls over the internal combustion engine 1. The control cycle is continuously executed by the controller 15 at a fixed time interval, e.g., every 10 milliseconds.

First, similarly to Step S1, in Step S11, the controller 15 determines if the fuel vapor treatment system is operating in a normal manner or not. If the fuel vapor treatment system is operating in a normal manner, then the controller 15 proceeds to Step S12 where it determines if the pressure difference obtained by subtracting the substitute atmospheric pressure PA from the true absolute pressure PAA is greater than or equal to the dead zone pressure PIA. The controller 15 proceeds to Step S13 if the pressure difference is less than or equal to the dead zone pressure PIA and to Step S14 if the pressure difference is greater than or equal to the same.

In Step S13, the controller 15 determines if the pressure difference obtained by subtracting the current true absolute pressure PAA from the substitute atmospheric pressure PA is greater than or equal to the dead zone pressure PIA. If the pressure difference is greater than or equal to the dead zone pressure PIA, then the controller 15 proceeds to Step S15. If the pressure difference is smaller than the dead zone pressure PIA, then the controller 15 proceeds to Step S16. In Steps S12 and S13, if the difference between the substitute atmospheric pressure PA and the current true absolute pressure PAA is larger than a prescribed pressure (the dead zone pressure PIA), then the control described in the following paragraph is executed so as to reduce this pressure difference.

In Step S14, the controller 15 adds a prescribed pressure change amount PRT to the substitute atmospheric pressure PA and sets the result as a new substitute atmospheric pressure PA. The controller 15 then controls the opening of the drain cut valve 11 based on this new substitute atmospheric pressure PA and holds the new substitute atmospheric pressure PA for one second. In Step S16, the controller 15 subtracts prescribed pressure change amount PRT from the substitute atmospheric pressure PA, sets the result as a new substitute atmospheric pressure PA, and holds the new substitute atmospheric pressure PA for one second. After Step S14 and Step S16 are completed, the control cycle ends. The pressure difference is reduced by gradually adding or subtracting a fixed amount to or from the substitute atmospheric pressure PA. As a result, abrupt changes in the pressure inside the purge piping are suppressed and stable engine operation and exhaust performance can be maintained.

In Step S15, the controller 15 determines the operating state of the drain cut valve 11. If the drain cut valve 11 is open, the controller 15 proceeds to Step S17 and sets the current true absolute pressure PAA as the substitute atmospheric pressure PA. Thus, the substitute atmospheric pressure PA is controlled so as to become the current actual (true) atmospheric pressure immediately and the control time can be reduced. Meanwhile, if the drain cut valve 11 is closed, then the controller 15 proceeds to Step S18 and maintains the current substitute atmospheric pressure PA.

If an abnormality is discovered in Step S11, then the controller 15 proceeds to Step S19, sets a fixed value as the substitute atmospheric pressure PA, and ends the control cycle.

Figure 4:
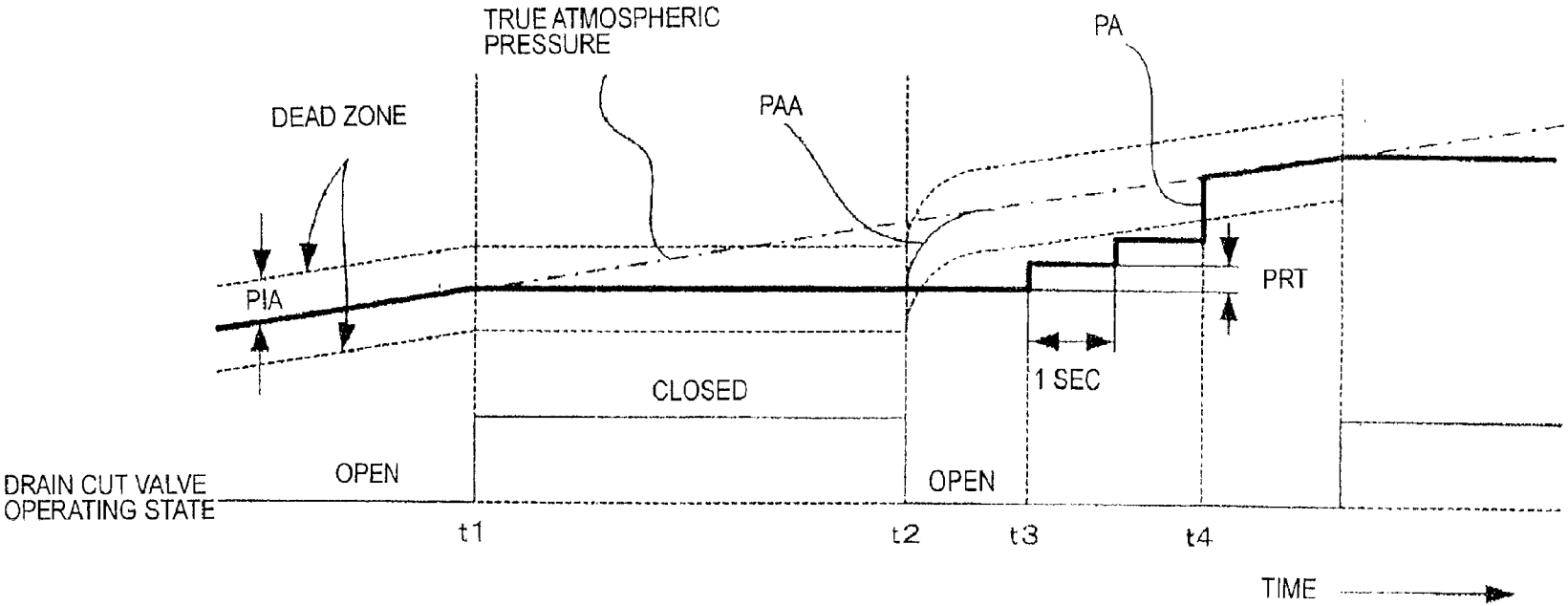
FIG. 4 timing chart indicating an operating state for each component of the fuel vapor treatment system illustrated FIG. 1 in accordance with the present invention.

FIG. 4 is a timing chart that shows the control content of the previously described flowcharts as a time series. As shown in FIG. 4, the actual (true) atmospheric pressure is assumed to change at a constant rate during the control cycle.

First at time t1, the drain cut valve 11 is closed and a constant value that is equal to the pressure when the drain cut valve 11 was open is set as the atmospheric pressure data (substitute atmospheric pressure) PA for controlling the engine. Thus, the atmospheric pressure data (substitute atmospheric pressure) PA for controlling the engine is different from the true atmospheric pressure.

At time t2, the drain cut valve 11 is opened and a pressure difference exists between the true absolute pressure PAA and the true atmospheric pressure. The true absolute pressure PAA swiftly changes so as to match the true atmospheric pressure. However, the substitute atmospheric pressure PA is changed gradually by a prescribed change amount PRT each time a fixed time period (e.g., one second) elapses such that the difference between the substitute atmospheric pressure and the true absolute pressure PAA slowly diminishes (between time t3 and time t4). This serves to prevent the control of the fuel injection quantity (or the like) of the internal combustion engine 1 from becoming unstable due to a sudden change in the atmospheric pressure, and thus, prevents the operation and exhaust of the engine 1 from becoming unstable.

Then at time t4, if the difference between the true absolute pressure PAA and the substitute atmospheric pressure PA is smaller than the dead zone pressure PIA, the substitute atmospheric pressure PA is set to the true absolute pressure PAA (i.e., the true atmospheric pressure) such that the pressure difference is quickly canceled. Thus, the time required to compensate for the difference that exists between the true atmospheric pressure and the pressure inside the piping when the drain cut valve 11 is opened (time t2) can be shortened.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2001-228962. The entire disclosure of Japanese Patent Application No. 2001-228962 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel vapor treatment system comprising:

a fuel tank;

a canister fluidly coupled to said fuel tank by a first pipe and configured to adsorb fuel vapor evaporated from said fuel tank;

a drain cut valve operatively coupled to said canister to control air flow into said canister;

a purge valve disposed in a second pipe fluidly coupled between said canister and an intake passage of an internal combustion engine into which fuel vapor flows from said canister;

a sensor configured and arranged to detect absolute pressure inside at least one of said first and second pipes; and an atmospheric pressure setting device configured and arranged to set a value detected by said sensor when said drain cut valve is open as a first atmospheric pressure to control the internal combustion engine.

2. The fuel vapor treatment system as recited in claim 1, wherein said atmospheric pressure setting device is further configured to hold said first atmospheric pressure set when said drain cut valve was open as a substitute atmospheric pressure when said drain cut valve has switched from an open state to a closed state, and said atmospheric pressure setting device configured to control the internal combustion engine based on said substitute atmospheric pressure.

3. The fuel vapor treatment system as recited in claim 2, wherein said atmospheric pressure setting device is further configured to gradually adjust said substitute atmospheric pressure to a revised substitute atmospheric pressure until a pressure difference between said substitute atmospheric pressure and a current atmospheric pressure detected by said sensor is less than or equal to a prescribed pressure, when said drain cut valve has switched from said closed state to said open state, and said atmospheric pressure setting device further configured to control the internal combustion engine based on said revised substitute atmospheric pressure, when said drain cut valve has switched from said closed state to said open state and said pressure difference between said substitute atmospheric pressure and said current atmospheric pressure detected by said sensor is less than or equal to said prescribed pressure.

4. The fuel vapor treatment system as recited in claim 3, wherein said atmospheric pressure setting device is further configured to adjust said substitute atmospheric pressure to a subsequent current atmospheric pressure currently detected by said sensor, and said atmospheric pressure setting device further configured to control the internal combustion engine based on said subsequent current atmospheric, when said pressure difference between said substitute atmospheric pressure and said subsequent current atmospheric pressure detected by said sensor has become less than or equal to said prescribed pressure.

5. A fuel vapor treatment system comprising:

storage means for containing fuel;

canister means for adsorbing fuel vapor evaporated from said storage means;

piping means for fluidly coupling said storage means to said canister means and an intake passage of an internal combustion engine;

drain cut valve means for controlling air flow into said canister means;

purge valve means for regulating fuel vapor flows from said canister means to the intake passage;

sensor means for detecting absolute pressure inside said piping means; and atmospheric pressure setting means for setting a value detected by said sensor means when said drain cut valve means is open as a first atmospheric pressure to control the internal combustion engine.

6. The fuel vapor treatment system as recited in claim 5, wherein said atmospheric pressure setting means is further configured to hold said first atmospheric pressure set when said drain cut valve means was open as a substitute atmospheric pressure when said drain cut valve means has switched from an open state to a closed state, and said atmospheric pressure setting means configured to control the internal combustion engine based on said substitute atmospheric pressure.

7. The fuel vapor treatment system as recited in claim 6, wherein said atmospheric pressure setting means is further configured to gradually adjust said substitute atmospheric pressure to a revised substitute atmospheric pressure until a pressure difference between said substitute atmospheric pressure and a current atmospheric pressure detected by said sensor means is less than or equal to a prescribed pressure, when said drain cut valve means has switched from said closed state to said open state, and said atmospheric pressure setting means further configured to control the internal combustion engine based on said revised substitute atmospheric pressure, when said drain cut valve has switched from said closed state to said open state and said pressure difference between said substitute atmospheric pressure and said current atmospheric pressure detected by said sensor means is less than or equal to said prescribed pressure.

8. The fuel vapor treatment system as recited in claim 7, wherein said atmospheric pressure setting means is further configured to adjust said substitute atmospheric pressure to a subsequent current atmospheric pressure currently detected by said sensor means, and said atmospheric pressure setting means is further configured to control the internal combustion engine based on said subsequent current atmospheric pressure, when said pressure difference between said substitute atmospheric pressure and said subsequent current atmospheric pressure detected by said sensor means has become less than or equal to said prescribed pressure.

9. A method of controlling an internal combustion engine, comprising:

measuring absolute pressure inside at least one of a first pipe and a second pipe of a fuel vapor treatment system, said first pipe fluidly connecting a fuel tank to a canister configured to adsorb fuel vapor evaporated from said fuel tank and said second pipe fluidly connecting said canister and an intake passage of said internal combustion engine into which fuel vapor flows from said canister;

determining an operational state of a drain cut valve operatively coupled to said canister of said fuel vapor treatment system;

setting a value measured inside at least one of said first and second pipes when said drain cut valve is open as a first atmospheric pressure; and controlling said internal combustion engine based on said first atmospheric pressure.

10. The method as recited in claim 9, further comprising holding said first atmospheric pressure set when said drain cut valve means was open as a substitute atmospheric pressure when said drain cut valve has switched from an open state to a closed state; and further controlling said internal combustion engine based on said substitute atmospheric pressure when said drain cut valve is in said closed state.

11. The method as recited in claim 10, further comprising further measuring absolute pressure inside at least one of said first and second pipes to obtain a current atmospheric pressure when said drain cut valve has switched from said closed state back to said open state;

gradually adjusting said substitute atmospheric pressure to a revised substitute atmospheric pressure until a pressure difference between said substitute atmospheric pressure and said current atmospheric pressure is less than or equal to a prescribed pressure; and further controlling said internal combustion engine based on said revised substitute atmospheric pressure, when said drain cut valve has switched from said closed state to said open state and until said pressure difference between said substitute atmospheric pressure and said current atmospheric pressure is less than or equal to said prescribed pressure.

12. The method as recited in claim 11, wherein further measuring absolute pressure inside at least one of said first and second pipes to obtain a subsequent current atmospheric pressure when said drain cut valve has switched from said closed state back to said open state;

changing said substitute atmospheric pressure to said subsequent current atmospheric pressure; and further controlling said internal combustion engine based on said subsequent current atmospheric pressure, when said drain cut valve has switched from said closed state to said open state and said pressure difference between said revised substitute atmospheric pressure and said subsequent current atmospheric pressure is less than or equal to said prescribed pressure.

* * * * *